US007258618B2

(12) United States Patent
Haut

(10) Patent No.: US 7,258,618 B2
(45) Date of Patent: Aug. 21, 2007

(54) REMOTE BATTERY COMPARTMENT FOR CHILD SWING MOTOR

(75) Inventor: Robert E. Haut, West Chester, PA (US)

(73) Assignee: Wonderland Nursery goods Co., Ltd, Taipei (TW)

( * ) Notice: Subject to any disclaimer, the term of this patent is extended or adjusted under 35 U.S.C. 154(b) by 69 days.

(21) Appl. No.: 11/283,448

(22) Filed: Nov. 18, 2005

(65) Prior Publication Data

US 2006/0128484 A1 Jun. 15, 2006

Related U.S. Application Data

(60) Provisional application No. 60/631,462, filed on Nov. 29, 2004.

(51) Int. Cl.
*A63G 9/16* (2006.01)

(52) U.S. Cl. ..... 472/119

(58) Field of Classification Search ..... 472/118–125; 297/273–282; 5/108, 109
See application file for complete search history.

(56) References Cited

U.S. PATENT DOCUMENTS 3,842,450 A * 10/1974 Pad ..... 5/109
4,822,033 A * 4/1989 Kohus et al. ..... 472/119
D345,777 S 4/1994 Pinch ..... D21/246
5,376,053 A * 12/1994 Ponder et al. ..... 472/119
5,525,113 A 6/1996 Mitchell ..... 472/119
D392,126 S 3/1998 Sack ..... D6/491
5,833,545 A 11/1998 Pinch ..... 472/119
6,059,667 A 5/2000 Pinch ..... 472/119
6,319,138 B1 * 11/2001 Fair et al. ..... 472/119
6,500,072 B1 12/2002 Myers ..... 472/119
6,544,128 B1 * 4/2003 Yang ..... 472/119
6,626,766 B1 * 9/2003 Hsia ..... 472/119
6,872,146 B1 * 3/2005 Paesang et al. ..... 472/119

* cited by examiner

*Primary Examiner*—Kien Nguyen
(74) *Attorney, Agent, or Firm*—Miller Law Group, PLLC

(57) ABSTRACT

A battery compartment is supported on the frame apparatus of a child's swing at a location that is remote from the electric motor powering the operative movement of the seat assembly. The battery compartment is located within a mounting housing mounted on a rear leg of the frame assembly where a corresponding front leg is detachably connected to the rear leg. The battery array housed in the battery compartment is connected to the remote electric motor by wiring positioned within the interior of the rear leg interconnecting the mounting housing in which the battery compartment is located and the housing in which the electric motor is located. The battery compartment is positioned below the top surface of the seat member in which an infant would be positioned and rearwardly of the seat member due to the curved configuration of the rear legs of the frame assembly.

17 Claims, 7 Drawing Sheets

REMOTE BATTERY COMPARTMENT FOR CHILD SWING MOTOR

CROSS-REFERENCE TO RELATED APPLICATIONS

This application claims priority on U.S. Provisional Patent Application Ser. No. 60/631,462, filed on Nov. 29, 2004, the entire contents of which are incorporated herein by reference.

BACKGROUND OF THE INVENTION

The present invention relates generally to a motor driven infant swing and, more particularly, to a remote battery compartment supported on the swing frame to locate the batteries away from an infant positioned on the swing sea.

Baby swings are used extensively by infant caregivers to soothe and to comfort the children. An infant swing consists primarily of a seat that securely holds the infant in a position elevated off the floor and a frame apparatus that supports the seat and allows the seat to move in a reciprocal manner, typically in a forward and rearward direction though some infant seats provide a side to side swinging motion.

The first infant swings consisted of a seat suspended from a frame that was formed with a support structure that extended over top of the infant and was supported by transversely opposed support legs that hold the overhead support structure in the elevated position. This overhead support structure restricted access to the child positioned in the seat as the support structure presented a physical barrier directly above the child. Such an infant swing can be seen in U.S. Design Pat. No. D345,777, issued on Apr. 4, 1994, to Daniel Pinch, et al. Not only is the overhead support structure a barrier to accessing the child in the swing from above the child, but the support structure also presented a barrier to viewing the infant.

As a solution to the barrier presented by the overhead support structure, the "open top" infant swing was developed. As can be seen in U.S. Pat. No. 4,822,033, issued to Louis Kohus and James Mariol on Apr. 18, 1989, the overhead structural support has been eliminated to provide an open access to the child in the seat from above. However, the child can be capable of grasping either of the transversely opposing support legs, particularly as the child is swinging back and forth between the support legs. Contact between the swinging child and one of the support legs can result in injury to the child. Furthermore, the child can potentially grab one of the support legs and pull his or herself forwardly to become dislodged from the seat, particularly if the child has not been properly secured within the seat by a safety harness.

The aforementioned open top infant swing evolved in a manner to eliminate the frame structure, i.e. the support legs, positioned forwardly of the swinging seat to provide an "open side" swing frame configuration for an infant swing. Such an open side infant swing can be found in the aforementioned U.S. Pat. No. 4,822,033, issued to Kohus and Mariol on Apr. 18, 1989. In the Kohus and Mariol patent, the infant swing is provided with both an open top and an open side structural configuration to provide the capability of viewing and accessing the child within the seat from substantially any position forwardly of the seat.

The swinging motion of most baby swings commercially available is similar to that of a pendulum that pivots from above and to the sides of the seat. Although this swinging motion can be maintained by a mechanical spring-operated swing mechanism, the swinging motion in most modern infant swings is maintained, typically, by a small electric motor located adjacent one of the seat pivots supported by the frame structure. The power for this electric motor is typically an array of dry cell batteries located within the same plastic housing as the electric motor. Examples of battery operated motors to affect the swinging motion of the infant seat from a frame support can be seen in U.S. Pat. No. 5,525,113, issued to Daniel Mitchell, et al on Jun. 11, 1996, and in U.S. Pat. No. 5,833,545, issued to Daniel Pinch, et al on Nov. 10, 1998.

Although such an arrangement of placing the dry cell batteries within the same covered housing as the electric motor is convenient for the wiring of the power source to the electric motor, this arrangement has several disadvantages as well. Locating the placement of the dry cell batteries above the swing seat, exposes the child positioned within the seat to being impacted by a dropped battery when the caregiver is forced to change the batteries to replace depleted batteries with fresh ones. Dry cell batteries are manufactured with acid within the battery container. Sometimes that acid can escape from the battery which would also present an injury risk to a child positioned within the seat. The placement of the battery array within the same housing as the electric motor also increases the height of the center of gravity of the swing, thus increasing the possibility of the swing tipping over. Lastly, since the spatial requirements of an electric motor and battery array are greater than for just the electric motor alone, the size of the housing needed to contain the electric motor and the battery array detracts from the ability to view the child.

Accordingly, it would be desirable to provide a child swing that is powered by an electric motor having the battery power supply positioned at a location remote from the location of the electric motor.

SUMMARY OF THE INVENTION

It is an object of this invention to provide a frame for an infant swing that overcomes the aforementioned disadvantages of the prior art.

It is another object of this invention that the swing frame apparatus provides a substantially unrestricted view of a child seated within the seat of the infant swing from positions forwardly of the infant swing.

It is a feature of this invention that the swing frame apparatus provides a substantially unrestricted physical access to a child seated within the seat of an infant swing from above and forwardly of the seat.

It is an advantage of this invention that the swing frame provides an open top and open side configuration for an infant swing.

It is still another object of this invention to provide a frame apparatus for an infant seat in which the front legs are joined with curved rear legs at a mid-portion thereof to permit said rear legs to project upwardly and forwardly therefrom.

It is another feature of this invention that the curved rear legs terminate at hanger housings from which the infant seat can be suspended.

It is another advantage of this invention that the hanger housings are supported in a cantilevered manner from the support provided by the joinder of the front legs with the rear legs at a mid-portion of the rear legs.

It is still another feature of this invention that the front legs can be detached from the rear legs to permit a compact storage of the swing frame apparatus with the seat structure removed from the frame apparatus.

It is still another advantage of this invention that the joinder of the front legs with the mid-portion of the rear legs is accomplished through a mounting housing supported on each rear leg for the detachable connection of a corresponding front leg.

It is yet another feature of this invention that the front leg is connected to the mounting housing through a quick disconnect mechanism.

It is still another object of this invention to utilize the mounting housing located below the motor housing to support the array of dry cell batteries to provide a power source for the electric motor providing the swinging motion for the infant seat.

It is a further feature of this invention that the dry cell battery array is located below the level of a child seated within the infant seat.

It is a further advantage of this invention that the location and the height of the dry cell battery array do not expose a child located within the swing seat to danger from acid leaking from the batteries located in the array.

It is still a further advantage of this invention that the location and the height of the dry cell battery array providing power to the electric swing motor do not expose a child within the swing seat to danger from a battery falling from the storage compartment housing the dry cell battery array.

It is still a further feature of this invention that the housing encompassing the electric motor for an infant swing can be formed in a smaller configuration by removing the dry cell battery array into a mounting housing located at a remote location with respect to the housing for the electric motor.

It is still a further advantage of this invention that the smaller housing for the electric motor on a child's swing enhances the ability to view the child in the swing seat.

It is yet another object of this invention to provide a structural component for an infant swing frame that is formed in a non-circular cross-section with a cross-sectional dimension that is greater in an axis parallel to the direction of movement of a swinging infant seat than in an axis perpendicular to the direction of movement.

It is still another feature of this invention that the cross-sectional configuration of the swing frame member is in an oval shape.

It is still another advantage of this invention that the swing frame having oval-shaped frame members is stronger in resisting the swinging movement of the infant seat than a swing frame formed with frame members having a circular cross-sectional shape.

It is yet another feature of this invention to provide a frame apparatus for a child's swing that is aesthetically pleasing while establishing an open top and open side configuration for access to and viewing of the swing seat.

It is still another feature of this invention that the swing frame apparatus utilizes a pair of transversely spaced curved rear legs that are oriented in an upwardly and forwardly reaching configuration with corresponding curved front legs that are oriented upwardly and rearwardly to intersect the rear legs at mounting housings to permit connection of the front legs to the rear legs at a mid-portion thereof.

It is another feature of this invention that the opposing front legs are joined at the lowermost forward aspects thereof by a molded front cross brace.

It is still another object of this invention to provide a remote battery compartment for the electric motor powering the movement of a child's swing, which is durable in construction, inexpensive of manufacture, carefree of maintenance, facile in assemblage, and simple and effective in use.

These and other objects, features and advantages are accomplished according to the instant invention by providing a battery compartment supported on the frame apparatus of a child's swing at a location that is remote from the electric motor powering the operative movement of the seat assembly. The battery compartment is located within a mounting housing mounted on a rear leg of the frame assembly where a corresponding front leg is detachably connected to the rear leg. The battery array housed in the battery compartment is connected to the remote electric motor by wiring positioned within the interior of the rear leg interconnecting the mounting housing in which the battery compartment is located and the housing in which the electric motor is located. The battery compartment is positioned below the top surface of the seat member in which an infant would be positioned and rearwardly of the seat member due to the curved configuration of the rear legs of the frame assembly.

BRIEF DESCRIPTION OF THE DRAWINGS

The advantages of this invention will be apparent upon consideration of the following detailed disclosure of the invention, especially when taken in conjunction with the accompanying drawings wherein.

DETAILED DESCRIPTION OF THE PREFERRED EMBODIMENT

Figure 6:
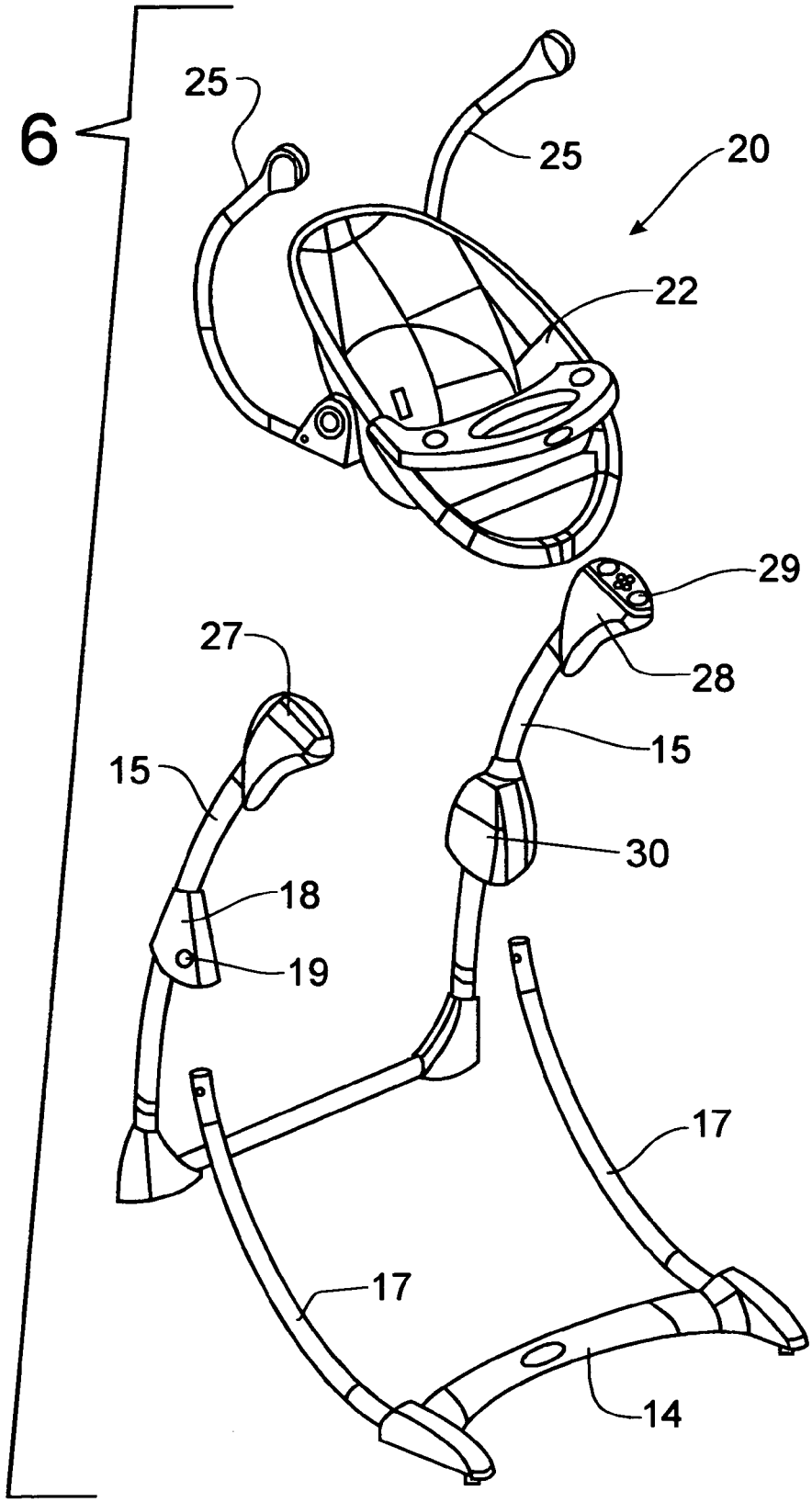
FIG. 6 is an exploded view of the major components of the infant swing disassembled to convert the infant swing into a more compact transport or storage configuration.
Figure 7:
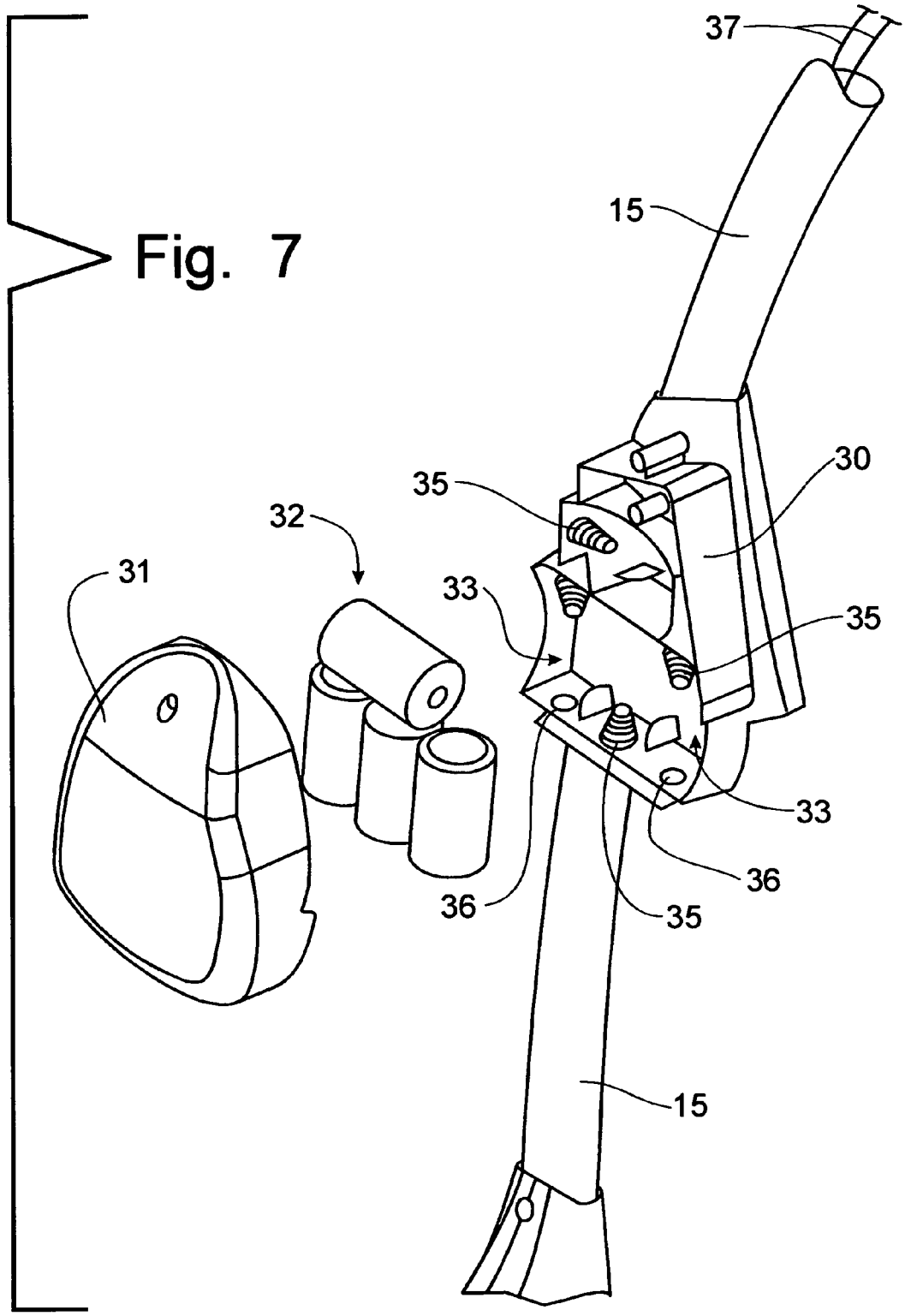
FIG. 7 is an enlarged exploded view of the battery case formed with one of the mounting housings at the junction of the corresponding front and rear legs of the frame apparatus.

Referring now to the drawings, an infant swing having a frame apparatus incorporating the principles of the instant invention can best be seen. The infant swing 10, as can best be seen in FIG. 6, includes as the major components thereof a frame assembly 12, including a pair of transversely spaced rear legs 15 and a corresponding pair of front legs 17, and a seat assembly 20 suspended from the frame assembly 12 for a fore-and-aft swinging movement. The seat assembly 20 is formed of a molded seat member 22 and a pair of transversely spaced hangers 25 that are connected to corresponding hanger housings 27, 28 positioned at the cantilevered ends of the rear legs 15, as will be described in greater detail below.

Referring now to FIGS. 1-6, the frame assembly 12 is formed with a pair of transversely opposing rear legs 15 that extend upwardly and forwardly front a rearward support position with a curvature thereof being concave facing downwardly and forwardly. The rear legs 15 terminate at upper hanger housings 27, 28 at the elevated distal ends thereof. One of the hanger housings 28 is formed to encompass an electric motor 29 that is operable to move the seat assembly 20 in a reciprocal manner in a fore-and-aft direction, as will be described in greater detail below. The curvature of the rear legs 15 provide an aesthetically pleasing shape that positions the hanger housings 27, 28 at an elevated, cantilevered position with no structure immediately below the hanger housings 27, 28.

A corresponding pair of curved front legs 17 is positioned forwardly of the rear legs 15 in fore-and-aft alignment therewith to extend rearwardly and upwardly from a front support position to intersect with the corresponding rear legs 17 at a central point thereof. Each of the rear legs 15 has mounted thereon at the central point thereof a mounting housing 18, 30 for the connection of the corresponding front leg 17 by a quick connect mechanism 19 that enables the front legs 17 to be detachably connected to the rear legs 17 and removed therefrom to convert the swing 10 into a storage configuration without the use of tools, such as a screwdriver or a wrench. The curvature of the front legs 17 is concave upwardly and forwardly so that the front legs 17 also do not provide any substantial structure beneath the hanger housing s 27, 28. The mating curvatures of the rear legs 15 and the front legs 17 establish an open side configuration of the frame assembly 12 with respect to access to a seat assembly 20 hanging from the hanger housings 27, 28.

The front legs 17 are interconnected by a molded front cross brace 14 that preferably has a curved configuration to correlate with the curved front and rear legs 17, 15 and provide an aesthetically pleasing appearance. Similarly, the transversely opposing rear legs 15 are also interconnected by a rear cross brace member 13 to provide a stable support for the suspended seat assembly 20 to resist the forces associated with the fore-and-aft swinging of an infant positioned in the seat assembly 20. The curvature of the molded front cross brace 14 eliminates the conventional tubular structural member that is positioned between the front legs. The rearwardly curved shape enables the caregiver to approach the seat assembly 20 for insertion or removal of the child from the seat member 22 without interfering with or tripping over the front cross brace found on conventional infant swings.

The seat assembly 20 includes a molded seat member 22 that is more particularly described in co-pending and commonly owned U.S. patent application Ser. No. 11/282,100, filed on Nov. 17, 2005, by Curtis M. Hartenstine, et al., the contents of which are incorporated herein by reference. The seat member 22 provides a support structure in which an infant can be placed and secured within the seat member 22 by conventional safety restraints (not shown) and permitted to reciprocally swing in a fore-and-aft direction. The seat member 22 is supported from the hanger housings 27, 28 by curved hangers 25 that connect with the seat member 22 and present a concave shape in a forward direction. As a result, the curvature of the hangers 25 contributes to the structure-free configuration beneath the hanger housings 27, 28, in addition to the mating curvatures of the front and rear legs 17, 15, to establish the open side configuration for access to the seat member 22.

Figure 1:
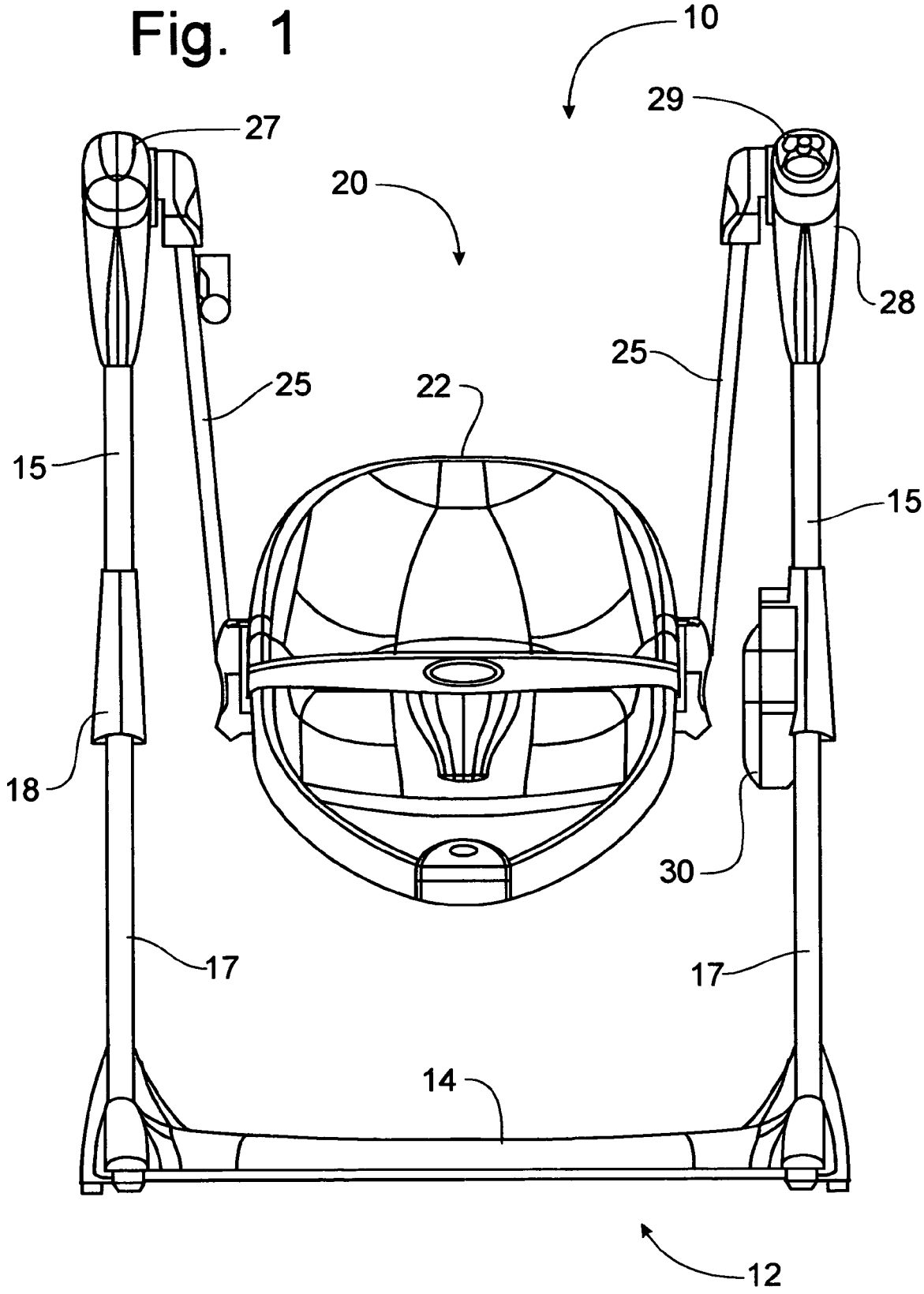
FIG. 1 is a front elevational view of an infant swing having a frame apparatus incorporating the principles of the instant invention.
Figure 2:
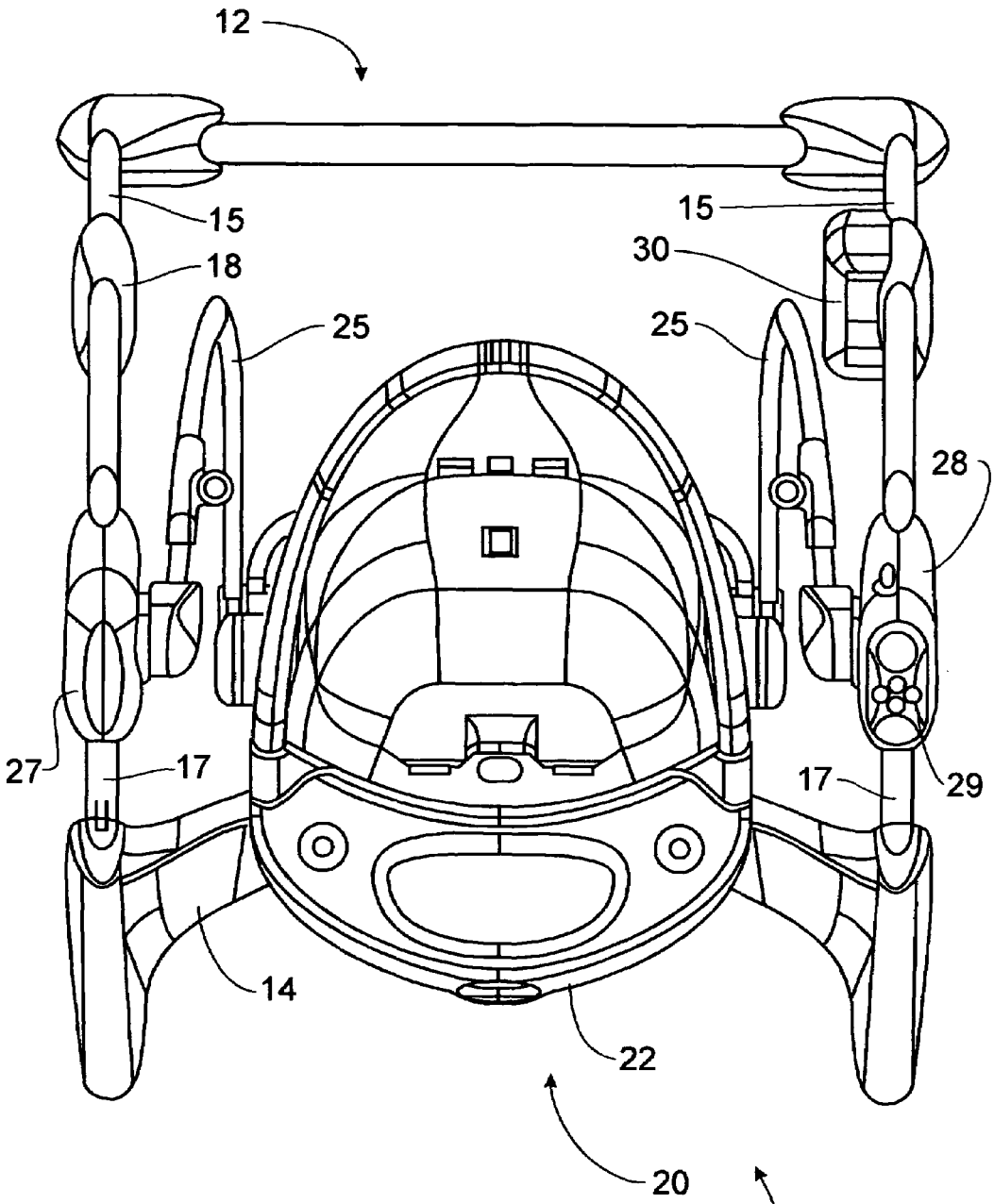
FIG. 2 is a top plan view of the infant swing depicted in FIG. 1.
Figure 3:
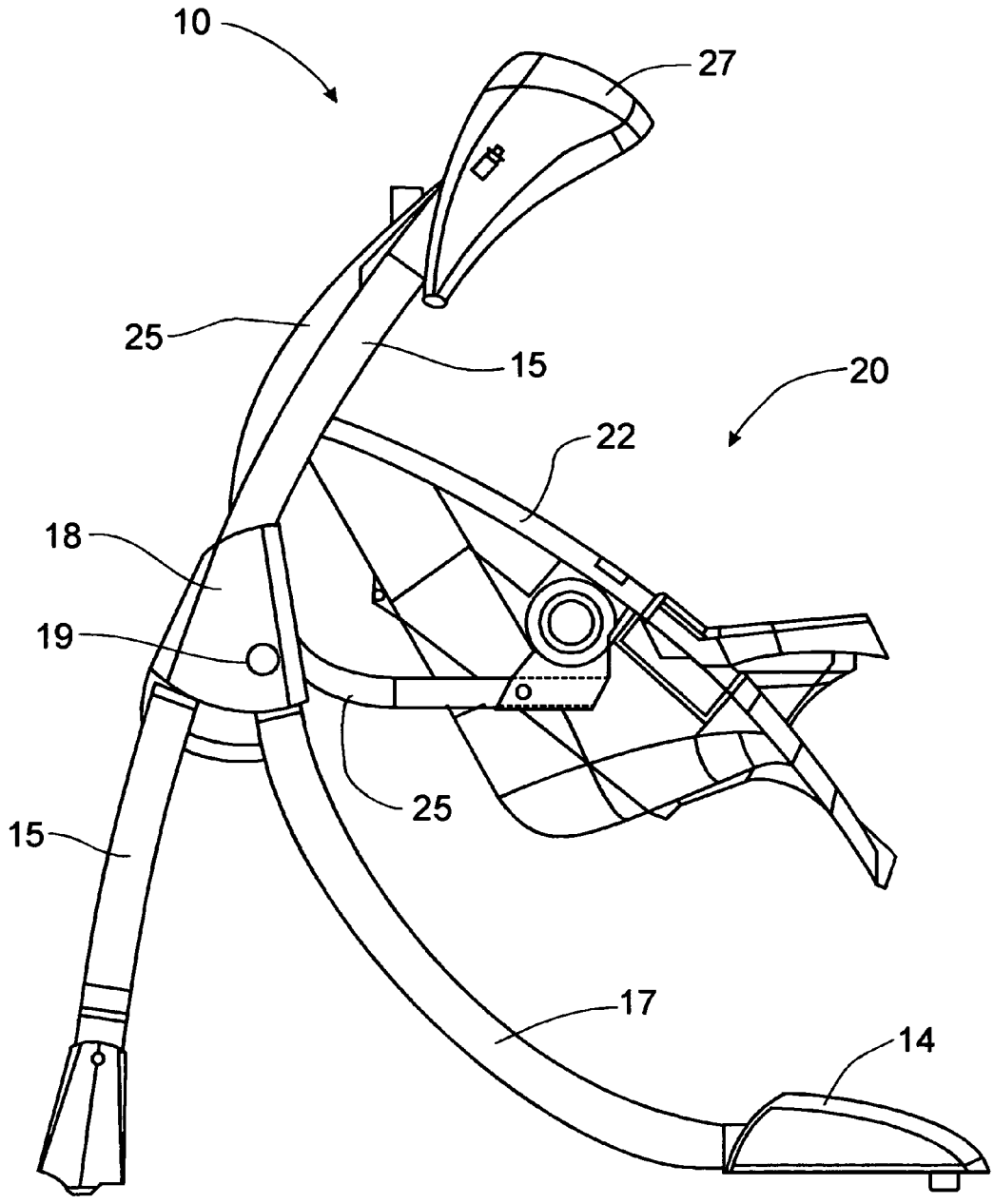
FIG. 3 is a right side elevational view of the infant swing shown in FIGS. 1 and 2.
Figure 4:
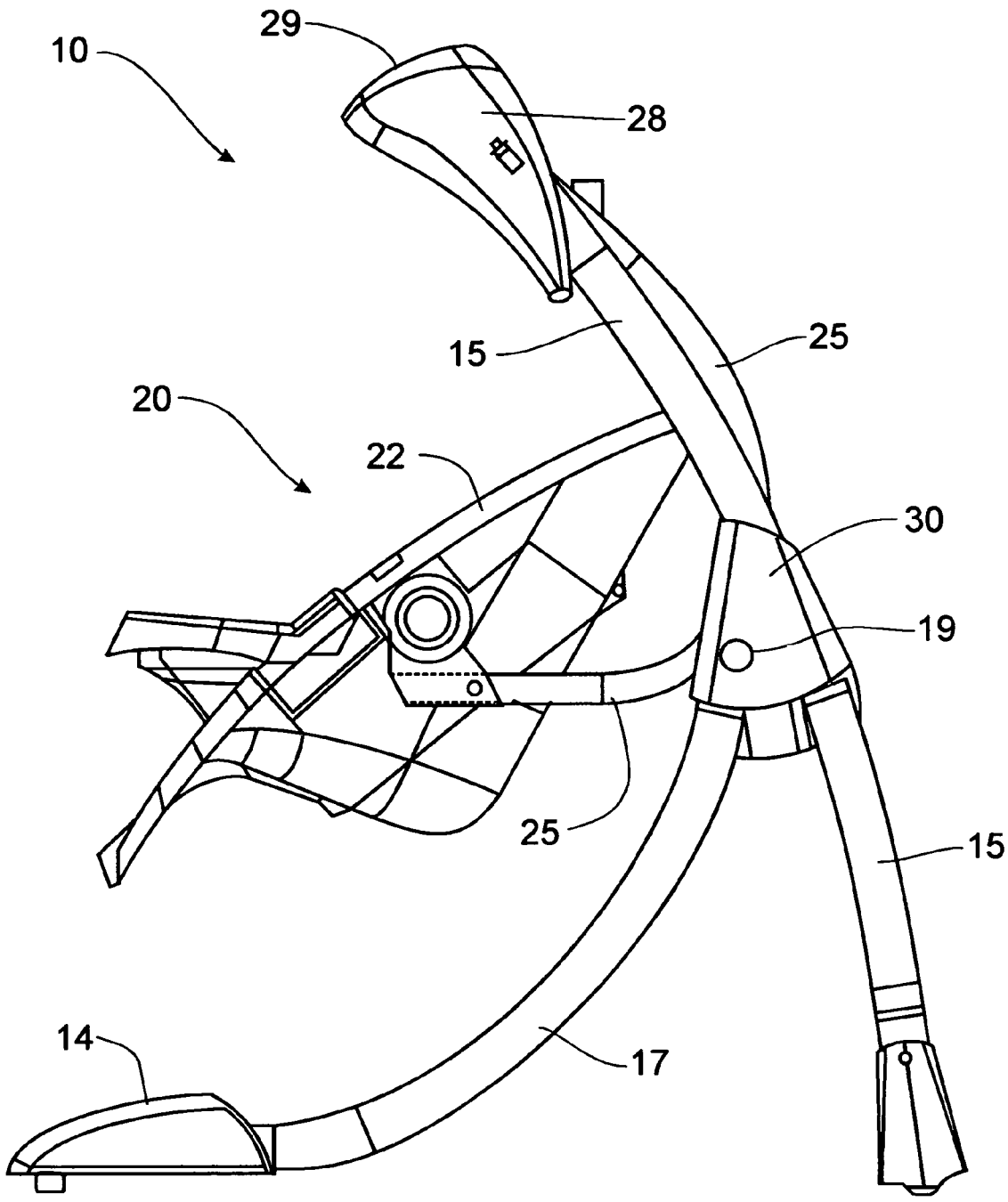
FIG. 4 is a left side elevational view of the infant swing shown in FIGS. 1 and 2.
Figure 5:
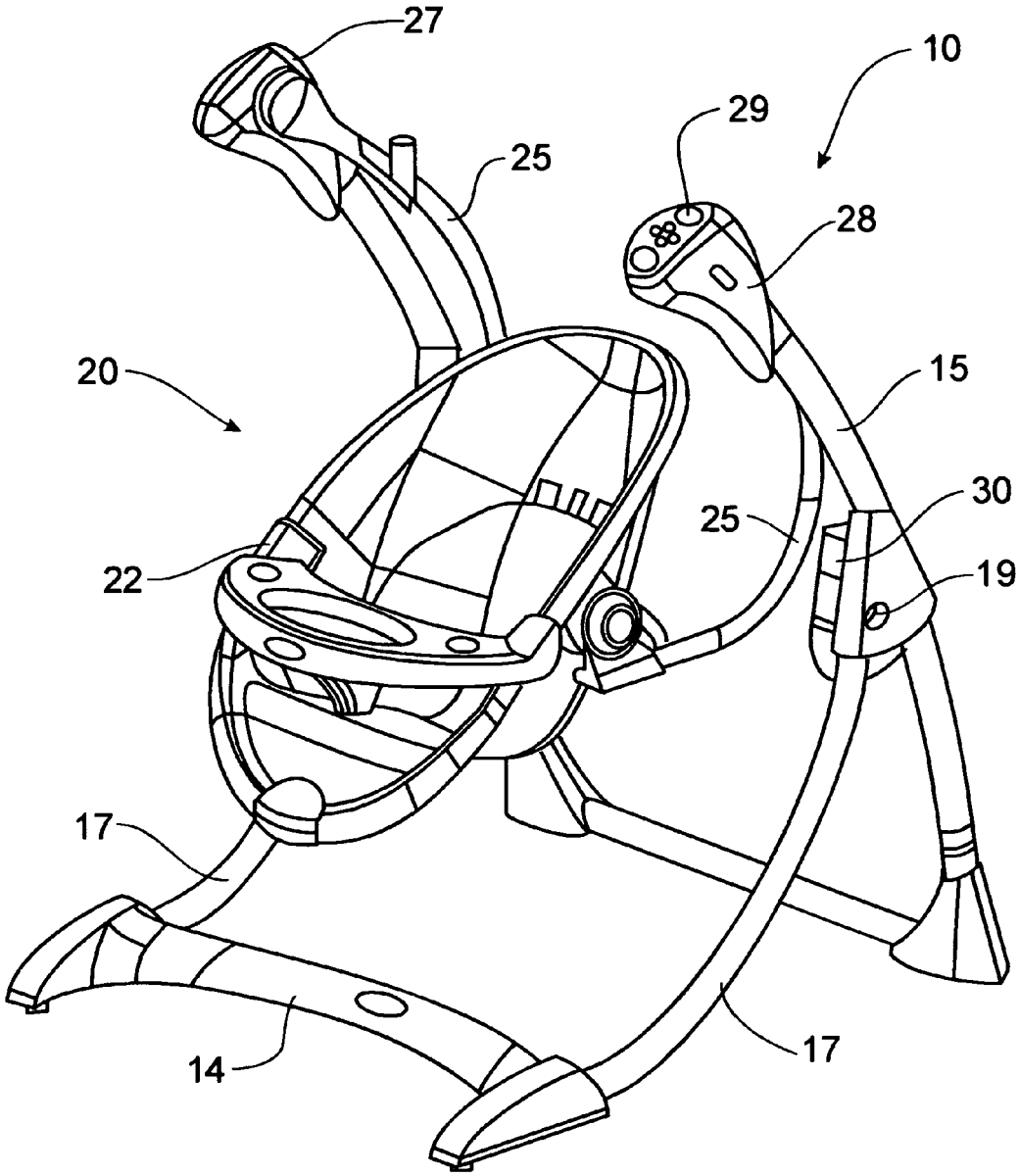
FIG. 5 is a left, front perspective view of the infant swing shown in FIGS. 1 and 2.
Figure 8:
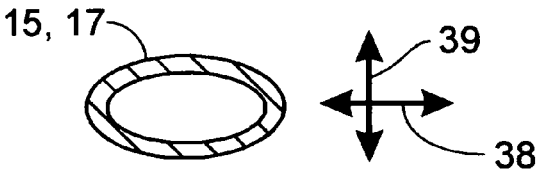
FIG. 8 is an enlarged cross-sectional view of a frame member taken along lines 8-8 of FIG. 7 to depict the oval-shaped cross-sectional configuration of the frame member.

As is best seen in FIG. 8, the structural members forming the front and rear legs 17, 15 are formed from an oval-shaped tubular member that provides a longer dimension in a direction parallel with the swinging movement of the seat assembly 12, depicted by the arrow 38, than in the direction perpendicular to the swinging movement of the seat assembly 12, represented by arrow 39. This oval-shaped cross-sectional configuration of the structural frame members provides a frame that is stronger in the resistance of the swinging motion than a frame having the same amount of material but formed in a conventional round cross-sectional configuration.

The transversely spaced hanger housings 27, 28 without any structural member interconnecting the upper distal ends of the rear legs 17 provides an open top configuration for the frame assembly 12, while the curved rear and front legs 15, 17, along with the curved hangers 25, provide an open side configuration for the frame assembly 12. Accordingly, the caregiver can access the child positioned in the seat member 22 from above, from in front, or from the side of the seat assembly 20 without interference from the frame assembly 12. These mating, curved shapes forming the frame assembly 12 establish an improved access, physically and visually, to the seat assembly 20 and any child positioned therein.

The mounting housing 30 mounted on the rear leg 17 on which the hanger housing 28 and the electric motor 29 are found is used to house an array of dry cell batteries 32 to provide power for operation of the electric motor 29. The placement of the battery array 32 at the connection of the front leg 17 with the curved rear leg 15 keeps the battery array 32 below the level of the head of the child positioned within the seat member 22, thus protecting the infant from possible injury from damaged batteries or from batteries that may be dropped onto the child seated in the seat member 22. The placement of the batteries 32 in the mounting housing 30 also enables the size of the hanger housing 28 in which the electric motor 29 resides to be smaller than if the batteries 32 were placed in the hanger housing 30 with the electric motor 29. Such geometry allows the two hanger housings 27, 28 to be sized similarly to provide an aesthetically pleasing frame structure.

The batteries 32 are mounted within individual compartments 33 having contacts 35, 36 arranged in series to provide electrical power for operating the electric motor 29 through wiring 37 that passes internally of the rear leg 15 to connect with the electric motor 29. A removable cover 31 retains the individual batteries 32 in their respective compartments 33 until replacement is required.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. In a child swing having a seat assembly mounted for reciprocal movement, said seat assembly having a top surface, the improvement comprising:

a pair of transversely spaced rear legs projecting upwardly and forwardly from a rear support position and terminating at respective elevated distal ends;

a pair of transversely spaced front legs extending upwardly and rearwardly from a front support position, said front legs intersecting the corresponding said rear legs at a central region of said rear legs;

a mounting housing mounted on each said rear leg at said central region to receive the corresponding said front leg for support thereof;

a hanger housing mounted on the distal end of each said rear leg for support of a seat assembly for reciprocal movement thereof in a direction of movement;

an electric motor supported in one of said hanger housings and being operably connected to said seat assembly to power said reciprocal movement thereof; and a battery compartment supported in one of said mounting housings located vertically below said top surface of said seat assembly and remotely of said electric motor to retain an array of batteries to provide electrical power to said electric motor.

2. The child swing of claim 1 wherein said electric motor and said battery compartment are mounted on the same rear leg.

3. The child swing of claim 2 wherein said battery compartment includes electrical contacts for engaging each said battery, said electrical contacts being connected to said electric motor by wiring located internally of said rear leg interconnecting said battery compartment and said electric motor.

4. The child swing of claim 3 wherein said battery compartment includes a removable cover to permit access to said array of batteries.

5. The child swing of claim 2 wherein said front and rear legs are curved to provide an open side access to said seat assembly.

6. The child swing of claim 5 wherein said curved front and rear legs position said mounting housings rearwardly of said seat assembly and rearwardly of said hanger housings.

7. In a child swing having a seat assembly mounted for reciprocal movement in a fore-and-aft direction on a frame assembly, an electric motor operably connected to said seat assembly to power said reciprocal movement, and a battery array electrically coupled by wiring to said electric motor to provide electrical power for the operation of said electric motor, the improvement comprising:

a pair of transversely spaced rear legs projecting upwardly and forwardly from a rear support position and terminating at respective elevated distal ends;

a pair of transversely spaced front legs extending upwardly and rearwardly from a front support position, said front legs intersecting the corresponding said rear legs at a central region of said rear legs;

a mounting housing mounted on each said rear leg at said central region to receive the corresponding said front leg for support thereof;

a hanger housing mounted on the distal end of each said rear leg for support of a seat assembly for reciprocal movement thereof in a direction of movement; and said array of batteries being located in a battery compartment supported on said frame assembly remotely from said electric motor.

8. The child swing of claim 7 wherein said electric motor is supported within one of said hanger housings, said battery compartment being supported within one of said mounting housings.

9. The child swing of claim 8 wherein said electric motor and said battery compartment are supported on the same rear leg of said frame assembly.

10. The child swing of claim 9 wherein said battery compartment includes electrical contacts for engaging said batteries within said array of batteries, said electrical contacts being connected to said electric motor by wiring passing internally through said rear leg interconnected said hanger housing supporting said electric motor and said mounting housing supporting said battery compartment.

11. The child swing of claim 10 wherein said seat assembly has a top surface, said battery compartment being located vertically below said top surface of said seat assembly.

12. The child swing of claim 11 wherein said battery compartment is located rearwardly of said seat assembly and rearwardly of said hanger housings.

13. A child swing comprising:

a pair of transversely spaced rear legs projecting upwardly and forwardly from rear support positions and terminating at respective elevated distal ends;

a pair of transversely spaced front legs extending upwardly and rearwardly from front support positions, said front legs intersecting the corresponding said rear legs at a central region of said rear legs;

a mounting housing mounted on each said rear leg at said central region to detachably receive the corresponding said front leg for support thereof such that said distal ends of said rear legs are cantilevered from said mounting housing;

a hanger housing mounted on said distal end of each said rear leg for support of a seat assembly for reciprocal movement thereof in a direction of movement;

a seat assembly including a seat member and a pair of opposing hangers interconnecting said seat member and respective said hanger housings, said front and rear legs providing an unrestricted access to said seat assembly from a side direction of said seat assembly, said cantilevered distal ends of said rear legs providing an unrestricted access to said seat assembly from above said seat assembly;

an electric motor supported in one of said hanger housings and being operably connected to said seat assembly to power said reciprocal movement thereof; and a battery compartment supported in one of said mounting housings to retain an array of batteries to provide electrical power to said electric motor.

14. The child swing of claim 13 wherein said electric motor and said battery compartment are supported on the same rear leg of said frame assembly.

15. The child swing of claim 14 wherein said battery compartment includes electrical contacts for engaging said batteries within said array of batteries, said electrical contacts being connected to said electric motor by wiring passing internally through said rear leg interconnected said hanger housing supporting said electric motor and said mounting housing supporting said battery compartment.

16. The child swing of claim 15 wherein said seat assembly has a top surface, said battery compartment being located vertically below said top surface of said seat assembly.

17. The child swing of claim 15 wherein said battery compartment is located rearwardly of said seat assembly and rearwardly of said hanger housings.

* * * * *